US008707881B2

(12) United States Patent
Armstrong et al.

(10) Patent No.: US 8,707,881 B2
(45) Date of Patent: Apr. 29, 2014

(54) TRIMARAN VEHICLE DECK ARRANGEMENT

(75) Inventors: Neville Anthony Armstrong, Coogee (AU); Samuel Abbott, Karawara (AU)

(73) Assignee: Austal Ship Pty Ltd., Henderson, Western Australia (AU)

( * ) Notice: Subject to any disclaimer, the term of this patent is extended or adjusted under 35 U.S.C. 154(b) by 74 days.

(21) Appl. No.: 13/376,013

(22) PCT Filed: Jun. 3, 2010

(86) PCT No.: PCT/AU2010/000688
§ 371 (c)(1), (2), (4) Date: Feb. 21, 2012

(87) PCT Pub. No.: WO2010/139017
PCT Pub. Date: Dec. 9, 2010

(65) Prior Publication Data

US 2012/0137945 A1 Jun. 7, 2012

(30) Foreign Application Priority Data

Jun. 3, 2009 (AU) ..... 2009902548

(51) Int. Cl.
*B63J 2/00* (2006.01)

(52) U.S. Cl.
USPC ..... 114/211; 114/61.1

(58) Field of Classification Search
USPC ..... 114/211, 61.1, 201 R
See application file for complete search history.

(56) References Cited

U.S. PATENT DOCUMENTS 3,868,920 A * 3/1975 Schirtzinger ..... 114/321
5,232,385 A * 8/1993 Hatfield ..... 440/44

(Continued)

FOREIGN PATENT DOCUMENTS

| | | |
|---|---|---|
| FR | 2 533 19 | 3/1984 |
| GB | 726808 | 3/1955 |
| GB | 1 525 473 | 9/1978 |

OTHER PUBLICATIONS

International Search Report for International Application No. PCT/AU2010/000688 mailed Jun. 23, 2010.

(Continued)

*Primary Examiner* — Stephen Avila
(74) *Attorney, Agent, or Firm* — Merchant & Gould P.C.

(57) ABSTRACT

A multi-hulled vessel (10) configured as a trimaran. The multi-hulled vessel (10) comprises a main hull (15) and at least one outer hull (17) to each side of the main hull, the main hull (15) and each side hull (17) adjacent thereto being interconnected by a bridge structure (19). The bridge structure (19) and the hulls (15, 17) connected thereby cooperating to provide a deck surface (21) adapted to carry a load. The main hull 15) is configured to define at least one engine room (45) below the deck surface (21) and trunking (70) for provision of services to the engine room. The trunking (70) is routed below the area of the deck surface (21) required for carrying a load. Because the trunking (70) is routed below the area of the deck surface (21) required for load-carrying, it does not extend through that area of the deck surface to impede load movements. This is particularly applicable for air trunking (70) for the delivery of ventilation air to the engine room (45) and discharge of ventilation air from the engine room. The air trunking (70) comprises one or more intake air trunks (71) and one or more discharge air trunks (73).

16 Claims, 5 Drawing Sheets

(56) References Cited

U.S. PATENT DOCUMENTS

| | | | | |
|---|---|---|---|---|
| 5,823,130 | A | 10/1998 | Kreyn et al. | |
| 6,932,012 | B1 | 8/2005 | Philips et al. | |
| 7,713,103 | B2 * | 5/2010 | Burgoyne | 440/88 C |
| 2006/0156966 | A1 * | 7/2006 | Stilson | 114/201 R |
| 2007/0151495 | A1 * | 7/2007 | Maloney et al. | 114/61.1 |

OTHER PUBLICATIONS

Supplemental European Search Report for corresponding EP Application No. 10 78 2831 mailed Dec. 4, 2013 (4 pages).

* cited by examiner

TRIMARAN VEHICLE DECK ARRANGEMENT

This application is a National Stage Application of PCT/AU2010/000688, filed 3 Jun. 2010, which claims benefit of Serial No. 2009902548, filed 3 Jun. 2009 in Australia and which application(s) are incorporated herein by reference. To the extent appropriate, a claim of priority is made to each of the above disclosed applications.

FIELD OF THE INVENTION

This invention relates to multi-hulled vessels such as trimarans having a centrally located main hull and at least one side hull on each side of the main hull.

The invention has been devised particularly, although not necessarily solely, for high speed commercial and military vessels, such as ferries, configured as trimarans for passenger and cargo transport, including vehicle transport.

BACKGROUND ART

The following discussion of the background art is intended to facilitate an understanding of the present invention only. The discussion is not an acknowledgement or admission that any of the material referred to is or was part of the common general knowledge as at the priority date of the application.

Trimarans are vessels with one long, thin hull and two side hulls (amahs) to provide stability and prevent the vessel from capsizing. Because the side hulls are small in comparison to the main hull, the main propulsion machinery is usually fitted into the main hull.

Sea-going trimarans have been manufactured as vehicular ferries, passenger ferries and as warships. In most of these designs, the space above the main propulsion machinery has been used as a cargo space. In the case of vehicular ferries, the space above the engine room is used for the transport of cars and other wheeled vehicles, including trucks and coaches. Due to the required hull configuration, trimarans built to date only have stern loading/unloading arrangements, necessitating that vehicles either turn around on-board, or reverse from the vessel. It is clearly advantageous to make the vehicle space as open as possible and without obstruction, so that trucks, including articulated vehicles, can safely manoeuvre on and off the vessel.

The engine room containing the main propulsion machinery is located below the cargo space and requires access for personnel and services, including ventilation trunking for air, and outlets for engine exhaust.

Generally, the required services have been taken through the deck above and surrounded by a casing mounted on that deck. This structure presents an obstruction to the easy maneuvering of vehicles, especially the larger trucks and coaches.

It is against this background and the problems and difficulties associated therewith, that the present invention has been developed.

DISCLOSURE OF THE INVENTION

According to a first aspect of the invention there is provided a multi-hulled vessel comprising a main hull and at least one outer hull to each side of the main hull, the main hull and each side hull adjacent thereto being interconnected by a bridge structure, the bridge structure and the hulls connected thereby cooperating to provide a deck surface adapted to carry a load, a superstructure including a substantially enclosed load space that includes a load deck provided by the deck surface, the main hull being configured to define at least one engine room below the deck surface, and trunking for provision of services to the engine room, the trunking being routed below the area of the deck surface required for carrying the load; wherein the services comprise air trunking for delivery and discharge of ventilation air to and from the at least one engine room.

Because the trunking is routed below the area of the deck surface required for load-carrying, it does not extend through that area of the deck surface to impede load movements. There may be trunking and other provision for service lines at the extreme forward end of the vessel, but such installations would not ordinarily impede load movements on the deck surface.

The load carried on the deck surface may be of any appropriate type, including vehicles and/or military cargo or payload.

Where vehicles are carried, the deck surface is preferably configured for vehicle movement and parking.

The services may further comprise air trunking for delivery of air for operating machinery in the engine room, including for example delivery of combustion air for engines.

In certain applications, further trunking may be provided for exhaust discharge, such as discharge of engine exhaust gases.

Preferably, the ventilation air trunking comprises at least one intake air trunk and at least one discharge air trunk. The trunks may extend to either or both sides of the vessel. In one arrangement, a respective intake air trunk and a respective discharge air trunk extend to opposite sides of the vessel.

Preferably, the intake air trunk and the discharge air trunk each comprises a first section extending outwardly under the area of the deck surface required for vehicle movement and parking, and a second section extending upwardly to the outboard side of the vessel for communication with the atmosphere.

The first section may be incorporated in the bridge structure.

The second section may be defined by a casing located adjacent to, or incorporated in, a side wall of the vessel While the casing may extend through the deck surface, it is does not obstruct that part of the deck surface utilised for load carrying such as vehicle transport, and in particular does not obstruct any vehicle accommodation area and any lanes required for vehicle movement.

The main hull may have a single engine room accommodating each of the engines, or there may be two or more engine rooms each accommodating at least one engine.

Preferably the bridge structure and the hulls connected thereby cooperate to provide two tunnels on opposed sides of the main hull, and wherein there is provided an exhaust system for discharging engine exhaust into one or both of the tunnels.

The or each engine room is typically located towards the aft end of the main hull, and access to the engine room is preferably provided from a location forward of, or close to the forward end of, the deck surface adapted for vehicle transport.

The access may be provided by a stairway or ladder extending between the deck surface and a service way leading to the or each engine room.

There may be an access hatch in the deck surface. The access hatch is preferably flush mounted so as to avoid providing an impediment to vehicle movement. The hatch would normally be closed while the vessel is in operation, but may be opened when the vessel is in harbour and when there are no vehicles on board.

Preferably, access to the or each engine room is also available through the access hatch. The access hatch is useful, for example, when servicing and maintenance operations are being performed in the engine room.

Preferably, there is provision of a safety barrier, such as safety railing, for the access hatch when it is in the open condition. The safety barrier may be configured for movement between deployed and collapsed conditions. In the collapsed condition, the safety barrier would preferably be stowed below the level of the deck surface so as not to impede movement over the deck surface. Preferably, there is provision for automatically moving the safety barrier between the deployed and collapsed conditions upon opening and closing of the access hatch.

The main hull may also be provided with an emergency escape passage extending laterally from the engine room(s).

According to a second aspect of the invention there is provided a multi-hulled vessel comprising a main hull and at least one outer hull to each side of the main hull, the main hull and each side hull adjacent thereto being interconnected by a bridge structure, the bridge structure and the hulls connected thereby cooperating to provide a deck surface adapted for vehicle transport, a superstructure including a substantially enclosed vehicle space that includes a vehicle deck provided by the deck surface, the main hull being configured to define at least one engine room below the deck surface, and trunking for provision of services to the engine room, the trunking being routed below the area of the deck surface required for vehicle movement and parking, wherein the services comprise air trunking for delivery and discharge of ventilation air and to from the at least one engine room.

According to a third aspect of the invention there is provided a multi-hulled vessel comprising a main hull and at least one outer hull to each side of the main hull, the main hull and each side hull adjacent thereto being interconnected by a bridge structure, the bridge structure and the hulls connected thereby cooperating to provide a deck surface adapted for vehicle transport and a tunnel between adjacent hulls, a propulsion system for delivering propulsive power to the main hull, the propulsion system comprising one or more engines, the main hull being configured to define at least one engine room below the deck surface accommodating the one or more engines, trunking for the delivery and discharge of ventilation air to and from the engine room, the trunking being routed below the area of the deck surface required for vehicle movement and parking; and an exhaust system for discharging exhaust from the one or more engines into one or both of the tunnels.

Preferably, the multi-hulled vessel is configured as a trimaran.

BRIEF DESCRIPTION OF THE DRAWINGS

The invention will be better understood by reference to the following description of one specific embodiment thereof as shown in the accompanying drawings in which.

BEST MODE(S) FOR CARRYING OUT THE INVENTION

Figure 1:
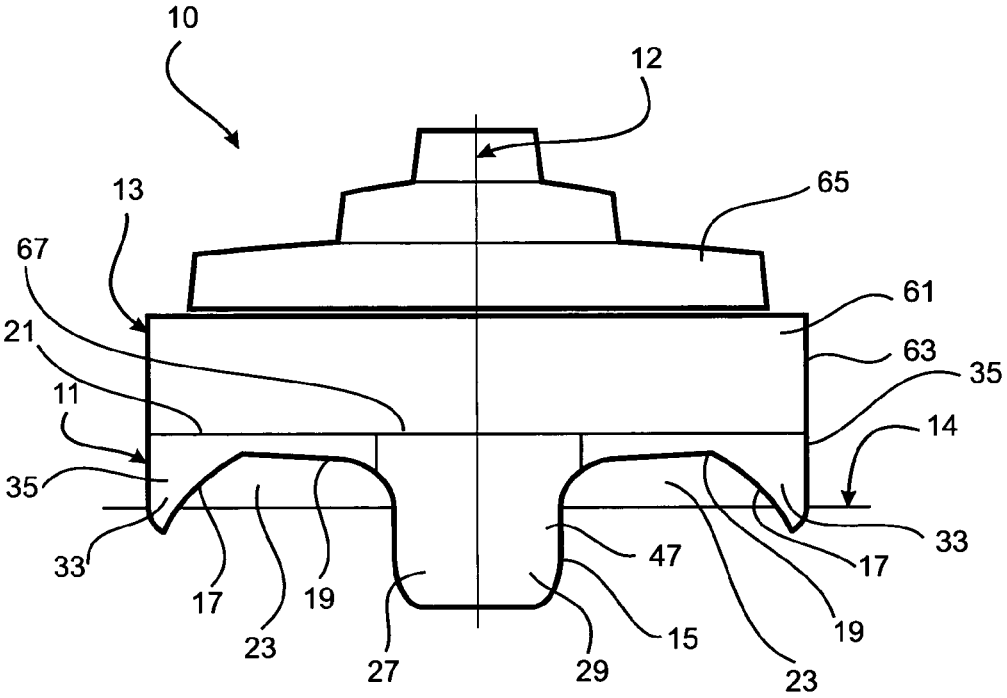
FIG. 1 is a schematic rear elevation of a multi-hulled vessel according to the embodiment configured as a trimaran having a main hull and two side hulls.

The embodiment shown in the drawings is directed to a multi-hulled vessel configured as a trimaran 10. The trimaran 10 according to the embodiment is a high speed, commercial, sea-going vessel operating as a ferry for passenger, and cargo transport, including in particular vehicle transport, or as a military vessel. Typically, the trimaran is of a size in the order of 80 to 130 meters, although it is of course not limited thereto.

The trimaran 10 comprises an understructrue 11 and a superstructure 13. In this embodiment, the understructrue 11 and superstructure 13 are both constructed primarily of aluminium, although of course any other appropriate construction materials may be used. The waterline in relation to the understructure 11 is identified in FIGS. 1, 2 and 3 by reference numeral 14. The centreline of the trimaran is identified by reference numeral 12.

The understructure 11 comprises a centrally located main hull 15 and two laterally spaced side hulls 17, commonly known as amahs.

The understructure 11 further comprises two integral bridge structures 19 interconnecting the main hull 15 and the two side hulls 17. The bridge structures 19 and the hulls 15, 17 cooperate to provide a deck surface 21 above which the superstructure 13 is located. The bridge structure 19 and the hulls 15, 17 cooperate to provide two tunnels 23 on opposed sides of the main hull 15.

The main hull 15 has a forward end terminating at a bow 25 and an aft end terminating at a stern 27 configured as a transom 29. Similarly, each side hull 17 has a forward end terminating at a bow 31 and an aft end terminating at a stern 33 configured as a transom 35.

A propulsion system 37 is provided for delivering propulsive power to the main hull 15. The propulsion system 37 comprises a plurality of propulsion engines 39 and a drive transmission system 41 for delivery of rotational power from each engine 39 to a propulsion device such as a propulsor 42 at the stern 27. In this embodiment, the propulsors 42 comprise steerable water jets. Each drive transmission system 41 comprises a driveshaft 43 and an associated gearbox 44. In this embodiment, the engines 39 comprise diesel engines, although other suitable types of engines may be used, including gas turbines. The engines 39 are located in an engine room 45.

In the arrangement illustrated, there are three propulsion engines 39. The trimaran 10 can, of course, be equipped with two, three or more engines if required. If desired, several engine rooms may be provided to accommodate the engines.

The main hull 15 also incorporates an aftermost compartment 51 between the engine room 45 and the stern 27 through which the driveshafts 43 extend. The aftermost compartment 51 provides a watertight and fire-protected environment through which the driveshafts 43 extend.

The superstructure 13 is configured to provide passenger and cargo transport, including vehicle transport. In the arrangement illustrated, the superstructure 13 provides a vehicle space 61 above the understructure 11 and between the outboard sides 63 of the trimaran 10, and a passenger accommodation space 65 above the vehicle space 61.

The deck surface 21 provides a vehicle deck 67 for the vehicle space 61. With this arrangement, the vehicle deck 67 is located above the engine room 45 within the main hull 15.

The vehicle deck 67 incorporates a vehicle accommodation area and lanes required for vehicle movement.

Access to the vehicle deck 67 for loading and unloading the vehicles is at the stern 27 of the trimaran 10. The loading and unloading operations can require manoeuvring of vehicles, including trucks and coaches, within the vehicle space 61, as well as onto and off the trimaran.

With a view to avoiding obstructions on the vehicle deck 67 which might impede vehicle movements and limit available vehicle accommodation within the vehicle space 61, services for the engine room 45 do not extend into the engine room from the vehicle deck 67 directly above, but rather are routed away to the side of the vehicle deck 67.

This is particularly so for air trunking 70 for the delivery of ventilation air to the engine room 45 and discharge of ventilation air from the engine room. Specifically, the trunking 70 is routed below the area of the vehicle deck 67 required for vehicle movement and parking.

Because the trunking 70 is routed below that the area of the vehicle deck 67 required for vehicle movement and parking, it does not extend therethrough to impede vehicle movements and limit available vehicle accommodation space.

Figure 2:
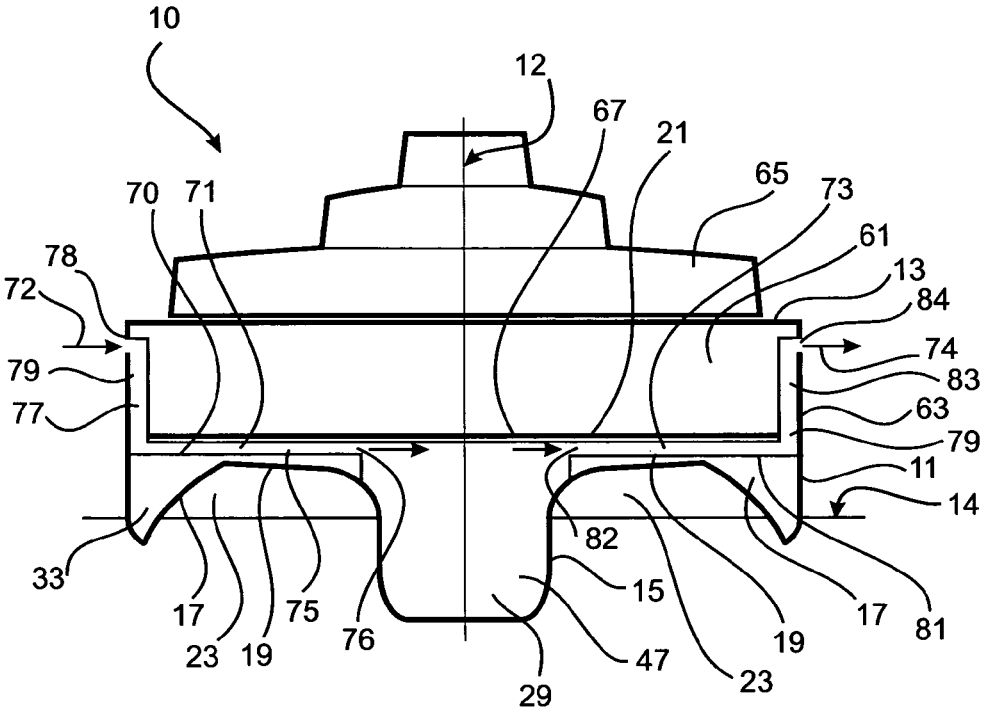
FIG. 2 is a view similar to FIG. 1 depicting in particular the ventilation system for the engine room.

The trunking 70 comprises one or more intake air trunks 71 and one or more discharge air trunks 73. The intake air trunks 71 and the discharge air trunks 73 may extend to either or both sides of the trimaran superstructure 13. In FIG. 2 of the drawings there is depicted intake air trunk 71 and discharge air trunk extending to opposite sides of the trimaran superstructure 13.

The intake air trunk 71 comprises a first intake section 75 communicating with the engine room 45 at outlet 76 and extending outwardly under the vehicle deck 67, and a second intake section 77 extending upwardly to open onto the adjacent outboard side 63 of the trimaran 10 at intake 78 for communication with atmosphere. In particular, the air intake 78 is located near the upper end of the vehicle space 61 so as to communicate with atmosphere well above the waterline 14 of the trimaran.

In the arrangement illustrated, first intake section 75 is defined by ducting incorporated in the adjacent bridge structure 19, and the second intake section 77 is defined by a casing 79 at the outboard side 63.

The discharge air trunk 73 comprises a first discharge section 81 communicating with the engine room 45 at intake 82 and extending outwardly under the vehicle deck 67, and a second discharge section 83 extending upwardly to open onto the adjacent outboard side 63 of the trimaran 10 at outlet 84 for communication with atmosphere. In particular, the outlet 84 opens onto the outboard side 63 near the upper end of the vehicle space 61 so as to communicate with atmosphere well above the waterline of the trimaran.

In the arrangement illustrated, first discharge section 81 is defined by ducting incorporated in the adjacent bridge structure 19, and the second discharge section 83 is defined by a casing 79 at the outboard side 63.

While not shown in the drawings, fans or blowers may be incorporated in the intake and air discharge trunks 71, 73 to facilitate air movement therealong. In FIG. 2 of the drawings the direction of flow of intake air is depicted by the arrow identified by reference numeral 72 and the direction of flow of discharge air is depicted by the arrow identified by reference numeral 74

Ventilation air delivered to the engine room can be used for various purposes including combustion air for the engine, and cooling of the engine room.

If so desired, combustion air for the engines can be delivered by separate air trunking dedicated for that purpose.

Other service lines (not shown) are also routed below that area of the vehicle deck 67 required for vehicle movement and parking so as to avoid impeding vehicle movements and limit available vehicle accommodation space.

Figure 3:
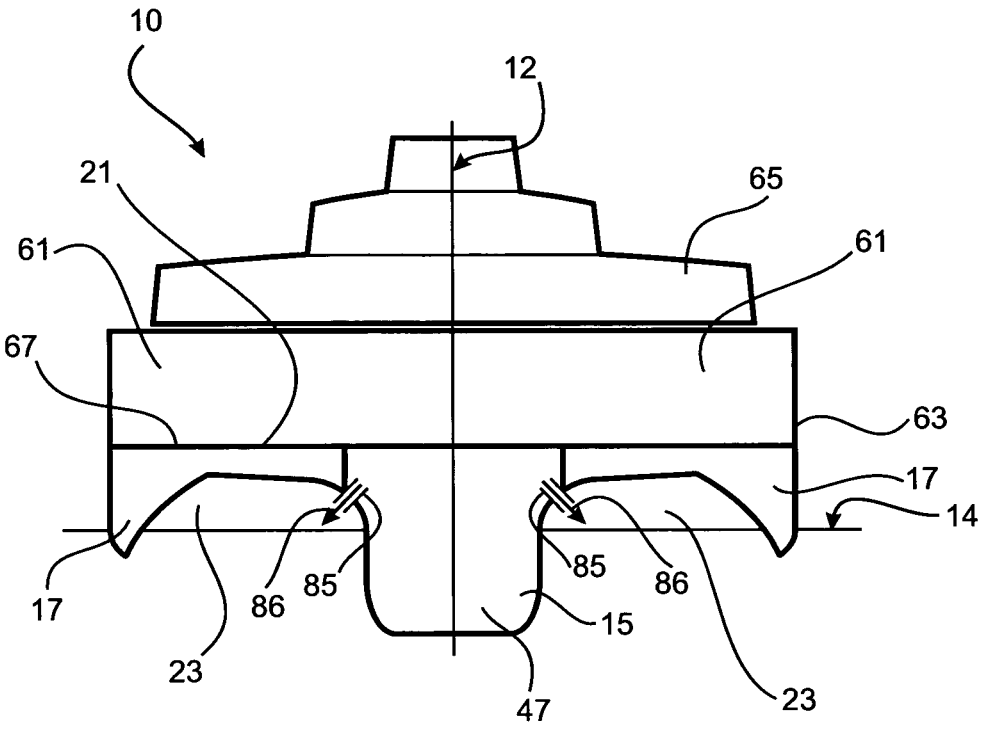
FIG. 3 is a view similar to FIG. 1 depicting in particular an engine exhaust system.
Figure 4:
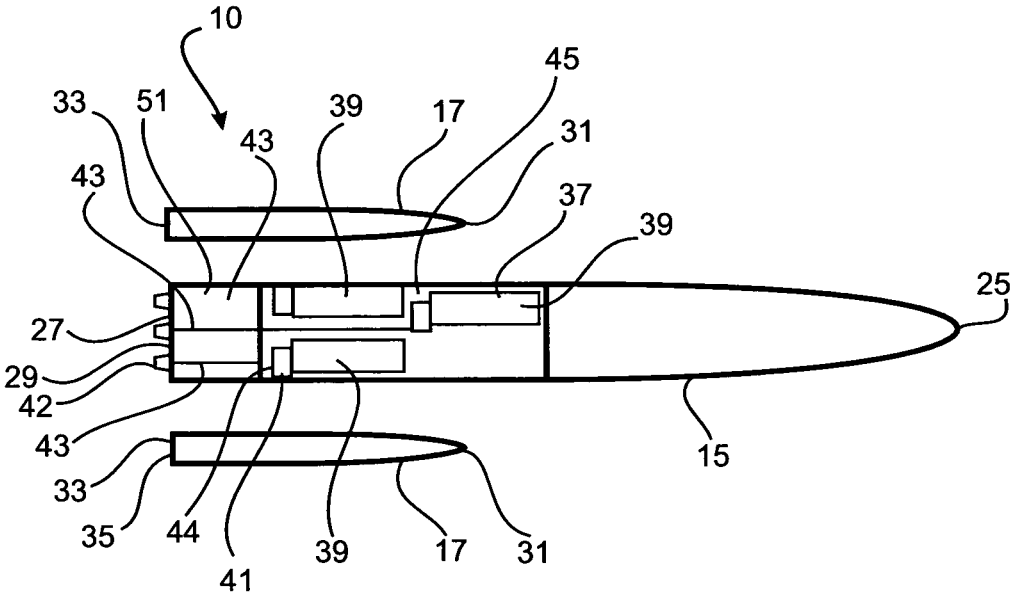
FIG. 4 is schematic plan view of the main hull and two side hulls illustrating in particular a propulsion system for the main hull comprising engines in the engine room.
Figure 5:
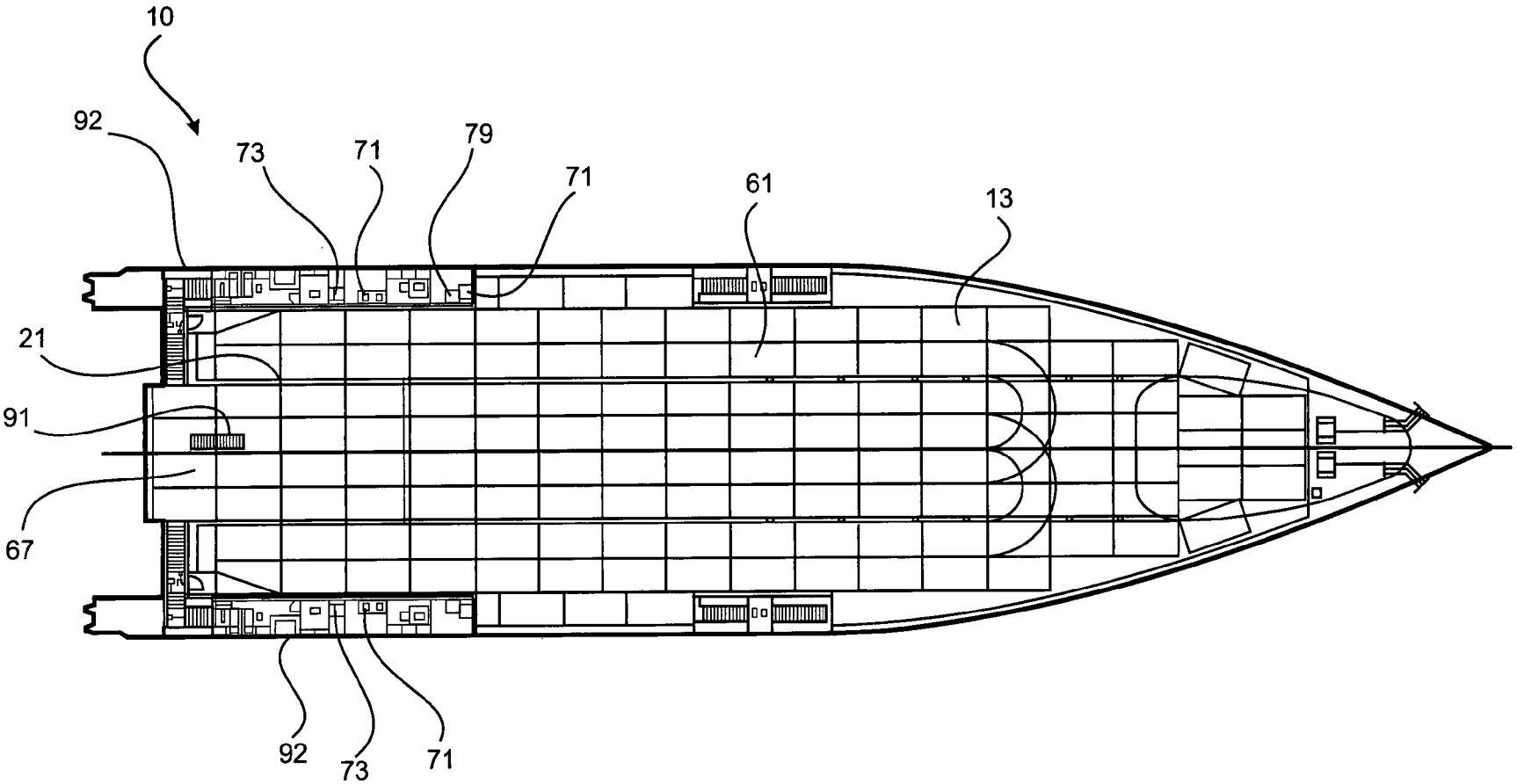
FIG. 5 is a schematic plan view of a vehicle deck provided in the vessel.

For similar reasons, the exhaust system for the propulsion engines 39 in the engine room 45 may be configured to discharge into the tunnels 23 through exhaust ports 85 provided in the main hull 15, as shown in FIG. 3. With this arrangement, the exhaust is directed into the tunnels 23 and does not need to be conveyed upwardly past the vehicle deck 67 for discharge to atmosphere. In FIG. 3 of the drawings the direction of exhaust flow through exhaust ports 85 is depicted by the arrows identified by reference numeral 86.

Of course, exhaust system may be configured to additionally, or alternatively discharge engine exhaust through exhaust trunking routed away to the side of the vehicle deck 67 in a manner similar to the air trunking 70; that is, such exhaust trunking would be routed below that the area of the vehicle deck 67 required for vehicle movement and parking so as not to extend through the vehicle deck to impede vehicle movements and limit available vehicle accommodation space.

The engine room 45 is located towards the aft end of the main hull 15, and access to the engine room is provided from a location forward of, or close to the forward end of, vehicle deck 67, clear of any vehicle turning area.

The access is provided by a stairway or ladder (not shown) extending between the vehicle deck 67 and a service way leading to the engine room 45.

Additionally, access to the engine room 45 may be available through an access hatch 91 in the vehicle deck 67. The access hatch 91 is flush-mounted so as not to provide an impediment to vehicle movement. The access hatch would normally be closed while the trimaran 10 is in operation, but may be opened when the trimaran is in harbour and when there are no vehicles on board. The access hatch affords for access such as, for example, when servicing and maintenance operations are required in the engine room 45.

While not shown in the drawings, there may be provision of a safety barrier, such as safety railing, when the access hatch 91 is in the open condition. The safety barrier may be configured for movement between deployed and collapsed conditions, with the safety barrier being stowed below the level of the surface of the deck 67 so as not to impede movement over the deck surface. Preferably, the safety barrier is adapted to move automatically between the deployed and collapsed conditions upon opening and closing of the access hatch 91. This provides a safety feature in that it ensures that the safety barrier is in place when the access hatch 91 is in the open condition.

The main hull 15 is also provided with an emergency escape passage (not shown) extending laterally from the engine room below the vehicle deck 67 and exiting through the deck in the vicinity of side 92 of the vessel.

From the foregoing, it is evident that the present embodiment provides a simple yet highly effective arrangement which optimises the functionality of the vehicle deck area.

It should be appreciated that the scope of the invention is not limited to the scope of the embodiment described, and that various changes and modification may be made without departing from the scope of the invention.

While the embodiment has been described in relation to a commercial ferry configured for passenger and vehicle transport, the invention is, of course, not limited thereto. The invention may be applicable to any appropriate multi-hulled vessel including such a vessel configured for military applications to carry cargo and/or payload.

Throughout the specification and claims, unless the context requires otherwise, the word "comprise" or variations such as "comprises" or "comprising", will be understood to imply the inclusion of a stated integer or group of integers but not the exclusion of any other integer or group of integers.

The claim defining the invention is as follows:

1. A multi-hulled vessel comprising a main hull and at least one outer hull to each side of the main hull, the main hull and each side hull adjacent thereto being interconnected by a bridge structure, the bridge structure and the hulls connected thereby cooperating to provide a deck surface adapted to carry a load, a superstructure including a substantially enclosed load space that includes a load deck provided by the deck surface, the main hull being configured to define at least one engine room below the deck surface, and trunking for provision of services to the engine room, the trunking being routed below the area of the deck surface required for carrying the load, wherein the services comprise air trunking for delivery and discharge of ventilation air to and from the at least one engine room;

wherein the trunking comprises an intake air trunk and a discharge air trunk; and wherein the intake air trunk and the discharge air trunk each comprises a first section extending outwardly under the area of the deck surface required for load carrying, and a second section extending upwardly to the outboard side of the vessel for communication with the atmosphere.

2. The multi-hulled vessel according to claim 1 wherein the services further comprise air trunking for delivery of air for operating machinery in the at least one engine room.

3. The multi-hulled vessel according to claim 1 wherein the intake air trunk and the discharge air trunk may extend to opposed sides of the vessel.

4. The multi-hulled vessel according to claim 1 wherein the first section is incorporated in the bridge structure.

5. The multi-hulled vessel according to claim 1 wherein the second section is defined by a casing located adjacent to, or incorporated in, a side wall of the vessel.

6. The multi-hulled vessel according to claim 1 wherein the bridge structure and the hulls connected thereby cooperate to provide two tunnels on opposed sides of the main hull, and wherein there is provided an exhaust system for discharging engine exhaust into one or both of the tunnels.

7. The multi-hulled vessel according to claim 1 wherein the at least one engine room is located towards the aft end of the main hull, and access to the at least one engine room is provided from a location forward of, or close to the forward end of, the deck surface adapted for vehicle transport.

8. The multi-hulled vessel according to claim 7 wherein access is provided by a stairway or ladder extending between the deck surface and a service way leading to the at least one engine room.

9. The multi-hulled vessel according to claim 1 further comprising an access hatch in the deck surface, the access hatch having open and closed conditions, the access hatch being flush with the deck surface when in the closed condition.

10. The multi-hulled vessel according to claim 9 wherein the access hatch provides access to the at least one engine room.

11. The multi-hulled vessel according to claim 9 further comprising a safety barrier for the access hatch when it is in an open condition.

12. The multi-hulled vessel according to claim 11 wherein the safety barrier is configured for movement between deployed and collapsed conditions.

13. The multi-hulled vessel according to claim 12 wherein the safety barrier is adapted to be stowed below the level of the deck surface when in the collapsed condition so as not to impede movement over the deck surface.

14. The multi-hulled vessel according to claim 13 wherein the safety barrier is adapted to move automatically between the deployed and collapsed conditions upon opening and closing of the access hatch.

15. The multi-hulled vessel according to claim 1, wherein the main hull is provided with an emergency escape passage extending laterally from the at least one engine room.

16. A multi-hulled vessel according to claim 1, of aluminium construction.

* * * * *